US005624062A

United States Patent [19]

Pedersen et al.

[11] Patent Number: 5,624,062

[45] Date of Patent: Apr. 29, 1997

[54] FLEXIBLE SPOUT CONTAINER

[76] Inventors: Knud A. Pedersen; Sloane K. Pedersen; Constance R. Pedersen, all of 16532 Cotuit Cr., Huntington Beach, Calif. 92649

[21] Appl. No.: 520,383

[22] Filed: Aug. 29, 1995

[51] Int. Cl.[6] ..... B67D 3/00

[52] U.S. Cl. ..... 222/528; 222/529

[58] Field of Search ..... 222/528–531; 251/4

[56] References Cited

U.S. PATENT DOCUMENTS

| | | | |
|---|---|---|---|
| 470,776 | 3/1892 | Beehler | 222/529 |
| 2,773,631 | 12/1956 | Bryant | 222/528 X |
| 2,792,976 | 5/1957 | Stewart | 222/530 X |
| 3,181,743 | 5/1965 | Libit et al. | 222/528 |
| 3,199,742 | 8/1965 | Hill | 222/529 X |
| 3,278,095 | 10/1966 | Johns | 222/528 X |
| 3,294,293 | 12/1966 | Johns | 222/528 X |
| 3,392,887 | 7/1968 | Bross | 222/528 |
| 4,080,989 | 3/1978 | Chapelsky et al. | 222/528 X |
| 4,216,880 | 8/1980 | Drelichowski | 222/528 X |
| 4,236,655 | 12/1980 | Humphries | 222/530 X |
| 4,426,027 | 1/1984 | Maynard, Jr. | 222/530 X |
| 4,446,994 | 5/1984 | Smith | 222/528 X |
| 4,602,728 | 7/1986 | Ha | 222/528 |
| 5,065,913 | 11/1991 | Glassner | 222/528 |
| 5,065,914 | 11/1991 | Chollet | 222/529 |
| 5,131,571 | 7/1992 | Nolley | 222/530 X |
| 5,370,279 | 12/1994 | Tardif | 251/9 X |
| 5,392,968 | 2/1995 | Dark | 222/529 |

*Primary Examiner*—Kevin P. Shaver

*Attorney, Agent, or Firm*—Gifford, Krass, Groh, Sprinkle, Patmore, Anderson & Citkowski, P.C.

[57] ABSTRACT

A container with a flexible spout adapted to selectively regulate the flow of liquid therefrom. The spout has a diameter appropriate for being received in an accommodating fill opening such as the oil fill opening of an automobile engine. The spout has an outer portion and a inner portion bendable about a portion of the spout located between the outer portion and inner portion. The bendable portion may be configured as an annular groove extending around the circumference of the spout. The inner portion extends from the top portion of the reservoir. The outer portion extends from the annular groove and terminates at a normally open outlet through which the oil from the container is poured into the oil fill. Threads are provided about the exterior of the outer portion of the spout adjacent the opening to threadedly receive a cap to cover the outlet and close the opening. The annular groove uniformly extends around the circumference of the spout. Upon the exertion of lateral pressure on the outer portion of the spout, the outer portion of the spout will pivot about the annular groove so that the cross-section of the spout is reduced at the annular groove. Upon inversion of the container, liquid will be inhibited from flowing therefrom until the pressure exerted on the outer portion of the spout is released.

8 Claims, 2 Drawing Sheets

FLEXIBLE SPOUT CONTAINER

BACKGROUND OF THE INVENTION

I. Field of the Invention

The present invention relates to a container for storing and dispensing a liquid, in general, and more particularly, to a novel container with a flexible spout which is adapted to selectively regulate the flow of liquid therefrom.

II. Background of the Invention

Dispensing liquid from a container neatly and without spillage is often a tedious and time consuming process. The process is made more difficult when one desires that the liquid be transferred to a receptacle having an opening that is hard to reach. This is nearly universally the case with the pouring and dispensing of motor oil into the oil fill of a typical automobile engine. Today, oil is typically stored in plastic bottles constructed of substantially inflexible material. These bottles are not conducive to transferring oil from the bottle to an oil fill opening that is usually located in the midst of a number of components in a closely fitted engine compartment. A major problem which occurs with the use of traditional bottles is that once the bottle is inverted the oil necessarily begins to flow. This flow may occur before the spout is suitably positioned over the oil fill. Moreover, the problem is aggravated if the oil fill opening is located in a position that the spout cannot even reach. Without the use of a funnel or other liquid directional device, it is nearly impossible for the user to pour oil into the oil fill opening without spilling oil on other parts of the engine compartment, on the user, or on the outside of the user's vehicle. Since oil is flammable, it may ignite if it contacts hot engine parts. Moreover, oil is a toxic waste material and therefore any leakage onto the ground may be damaging to the environment.

Dispensing containers in which fluid is selectively permitted to flow through are known. U.S. Pat. No. 2,773,631 issued to Bryant discloses a measuring and dispensing device that can permit or prevent the flow of fluid therethrough. The Bryant container employs a flexible tube that is bendable about two lines to selectively permit fluid flow. A normally closed aperture is provided at the end of the spout that allows the user to selectively measure a certain amount of liquid to flow through.

U.S. Pat. No. 4,602,728 issued to Ha discloses a container with an extensible neck that allows the neck to act as a funnel to direct fluid to a receptacle. To dispense liquid from the container, the spout is pulled causing the neck to expand, and the neck is then adjusted to the receptacle. The containers disclosed in Bryant and Ha, although useful, have some disadvantages. To permit fluid flow in the Bryant container, one must not only remove pressure from the dispensing device but also force open the aperture at the end of the spout to open. The Ha container requires substantial modifications and the use of non-standard components and therefore is costly to manufacture.

Accordingly, it is therefore a general object of the present invention to provide an improved dispensing container that is economical to manufacture, compact, light weight, simple to use, and can be used effectively in a variety of different situations.

It is a further object of the present invention to provide an improved dispensing container that is simply constructed of one-piece molded plastic.

It is a further object of the present invention to provide an improved dispensing container in which liquid may be poured without spillage into receptacles in hard to access areas.

In accordance with these and many other objects, I have invented a unique dispensing container that solves the problems that others have failed to address.

SUMMARY OF THE PRESENT INVENTION

The present invention is directed to a container with a flexible spout which is adapted to selectively regulate the flow of liquid therefrom. The container is fashioned from a hard, yet flexible material such as plastic and is molded to have a reservoir portion having a bottom, sides, and a top. The top includes an elongated flexible spout having a diameter appropriate for being received in an accommodating fill opening such as the oil fill opening of an automobile engine. The spout has an outer portion and an inner portion bendable about a portion of the spout located between the outer portion and inner portion. The bendable portion may be configured as an annular groove extending around the circumference of the spout, as in the preferred embodiment, but such configuration is not necessary. The inner portion extends from the top portion of the reservoir to the annular groove. The outer portion extends from the annular groove and terminates at an open outlet through which the fluid from the container is poured into the fluid fill. Threads are provided about the exterior of the outer portion of the spout adjacent the outlet to threadedly receive a cap to cover the outlet and close the opening. The configuration of the annular groove provides for the outer portion of the spout to pivot about the annular groove upon the exertion of slight pressure on the outer portion of the spout.

In the normal unstressed condition, the spout has a passage having a succession of cross-sections of substantially equal area from the inner portion of the spout through the annular groove to the outer portion. The succession of substantially equal cross-sections permits the flow of fluid freely from the container when the container is inverted. Exerting lateral pressure on the outer portion of the spout, however, causes opposite sides of the annular groove to move closer together necessarily reducing the cross-section of the spout at the annular groove. As the cross-section of the spout at the annular groove is reduced near zero, fluid is prohibited from flowing from the container when the container is inverted. By straightening and removing the pressure from the outer portion of the spout, fluid is then permitted to flow from the container.

BRIEF DESCRIPTION OF THE DRAWINGS

Additional objects, advantages, and features of the present invention will become apparent from the following description and appended claims, taken in conjunction with the accompanying drawings in which:

DETAILED DESCRIPTION OF A PREFERRED EMBODIMENT

It should be understood that the following description of the preferred embodiment is merely exemplary in nature and is in no way intended to limit the invention or its applications or uses.

For example, the following description of the dispensing container, although designed for use in conjunction with the dispensing of oil, may be used for other purposes such as the dispensing of antifreeze, transmission fluid, brake fluid, or any other liquid in which it would be useful to selectively permit the flow of liquid therethrough to allow correct positioning of the spout when the container is inverted. Modifications and variations of the present invention will readily occur to those skilled in the art.

Figure 1:
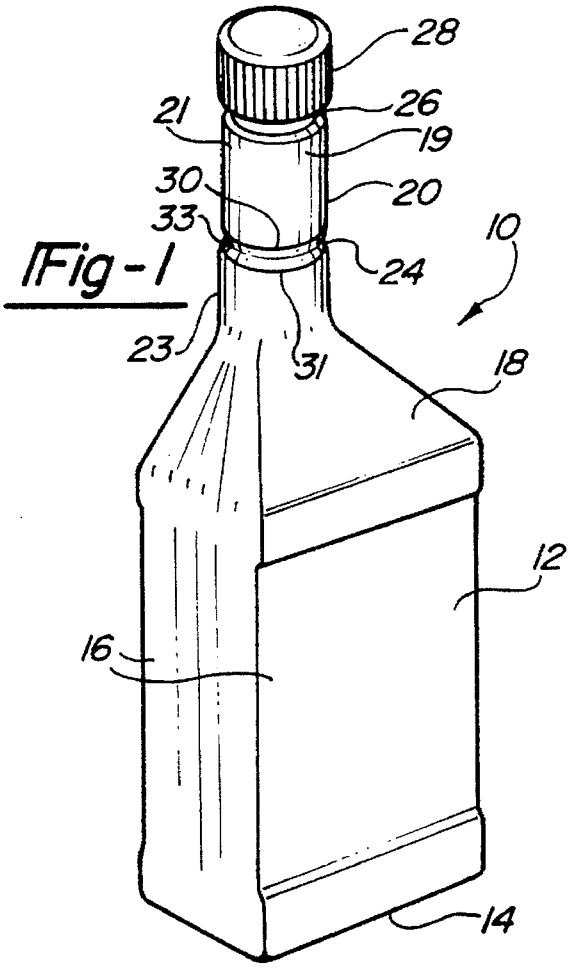
FIG. 1 is a perspective view of the present invention.

Referring now to the drawings, in which corresponding parts are identified with the same reference numeral, and more particularly to FIG. 1, the dispensing container of the present invention is designated generally at 10. The container 10 is generally fashioned from a hard, yet flexible plastic, such as polyethylene, which is of a generally shape retaining nature and is characterized by the property that it may be flexed repeatedly within the anticipated life of the device. The container is molded to have a reservoir portion 12 having a bottom 14, sides 16, and top 18.

Figure 2:
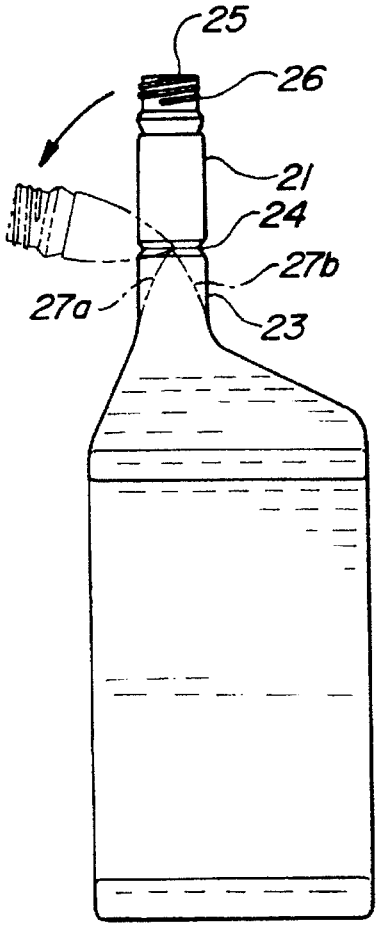
FIG. 2 is a side view of the present invention showing the bendable nature of the spout.

An elongated flexible spout 20 extending from the top 18. The spout 20 has a passage 19 having diameter appropriate for being received in an accommodating fill opening such as the oil fill opening of an automobile engine. The spout 20 has an outer portion 21 and a inner portion 23 separated by annular groove 24. The annular groove 24 has opposing side walls 30, 31 and a bottom surface 33 extending therebetween. The inner portion 23 extends from the side portions 16 of the reservoir 12. The outer portion 21 extends from the annular groove 24 and terminates at an open outlet 25 (as shown in FIG. 2) through which the oil from the container is poured into a port 35 of an oil fill. Threads 26 are provided about the exterior of the outer portion 21 of the spout 20 adjacent the opening to threadedly receive a cap 28 to cover the outlet 25 and close the opening.

Figure 4:
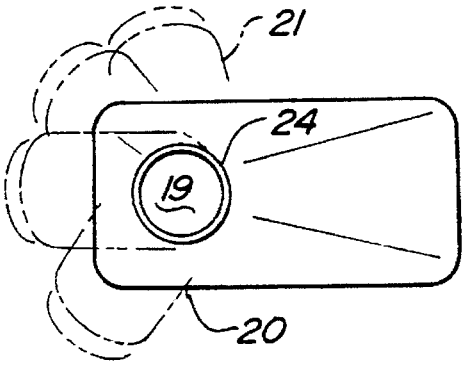
FIG. 4 is an overhead view of the present invention showing more particularly the movement of the outer portion of the spout about the annular groove.

Referring now to FIG. 2, the outer portion 21 of the spout 20 is shown bendable about the annular groove 24. The annular groove 24 uniformly extends around the circumference of the spout 20 such that the outer portion 21 of the spout 20 is bendable in a number of directions (as shown in FIG. 4). In the normal unstressed condition, the passage 19 has a succession of cross-sections of substantially equal area from the inner portion 23 of the spout 20 through the annular groove 24 and to the outer portion 21. Similarly, the area of the cross-section of the open outlet 25 is substantially the same as that of the cross-section of the passage through outer portion 21 and inner portion 23 of the spout 20. The succession of substantially equal cross-sections permits the flow of fluid freely from the container 10 when the container 10 is inverted and the spout is in an extended position, as shown in FIG. 1. Shown in FIG. 2, exerting pressure on the outer portion 21 of the spout 20, however, causes the outer portion to pivot about the annular groove to folded position with opposing portions 27*a* and 27*b* of the spout collapsed inwardly together, thereby reducing the cross-section of the spout 20 at the annular groove. As the outer portion 21 of the spout 20 experiences a bending of approximately ninety degrees, as shown in FIG. 2, the cross-section of the passage 19 at the annular groove 24 is reduced near zero. In this position, fluid is prohibited from flowing from the container 10 when inverted. It should be noted that when the three on the outer portion 21 of the spout 20 which causes the bending is removed, the spout 20 will quickly return to its normal unstressed condition.

The bendable nature of the spout 20 that allows for the selective direction and volume of flow of liquid therethrough permits one to dispense fluid into the opening of a fill without the use of a funnel or other liquid directional device.

Figure 3:
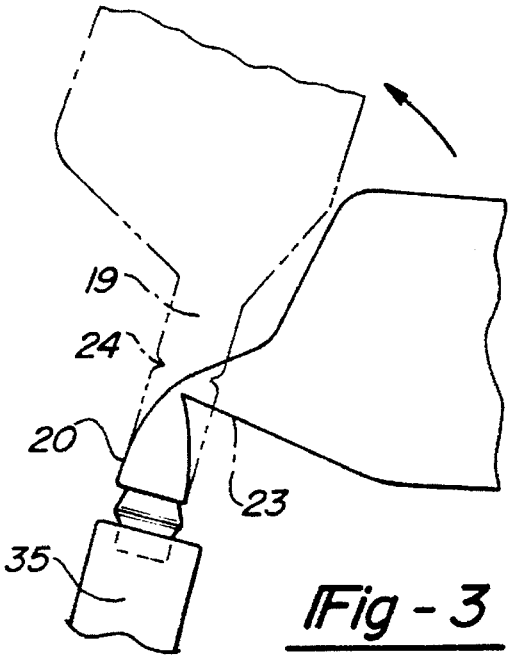
FIG. 3 is a fragmented perspective view showing the emptying of fluid from the container.

As shown in FIG. 3, to selectively dispense the fluid from the container into a fluid fill, the user need only exert pressure on the outer end of the spout 20 so that the spout 20 bends about the annular groove 24 and reduces the cross-section of the passage to near zero. While retaining pressure on the outer portion 21 of the spout 20, the user then inverts the container 10 and positions the outlet 25 of the outer portion 21 over the opening of the oil fill. Upon release of pressure on the outer portion 21 of the annular groove 24, the spout 20 will return to its extended position and fluid will flow from the container 10 through the full length of the spout 20 and into the oil fill.

Turning now to FIG. 4, it is clearly seen that the outer portion 21 of the spout 20 is bendable about the annular groove 24 in a plurality of orientations. This flexure facilitates access to the fluid fill by virtue of the nature of the angle of the spout 20 relative to the container 10 alignment.

Figure 5:
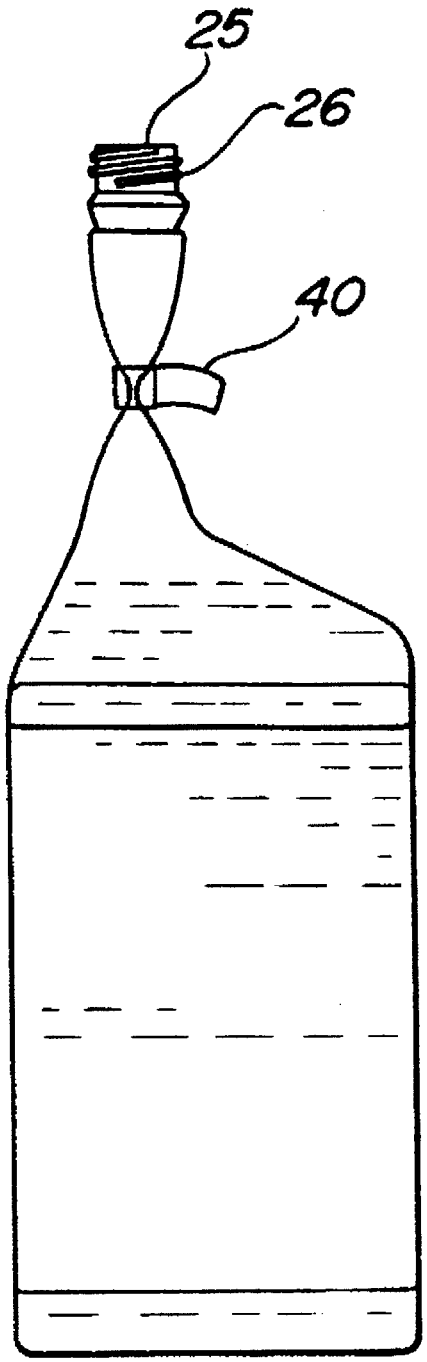
FIG. 5 is a side view of an alternative embodiment of the present invention showing a tier or clasp secured around the spout.

In keeping within the spirit of the invention, in another embodiment of the invention depicted in FIG. 5, other restricting means such as a tie or clasp 40 may be secured around the circumference of the annular groove 24 to restrict the flow of fluid when the container 10 is inverted. In this embodiment, it would not be necessary to exert pressure on the outer portion 21 of the spout 20 to prohibit fluid flow. Instead, adjusting the position of the tie or clasp 40 would have a similar effect. The bendable portion may be formed with ribs or the like to facilitate closure of the passage when the clasp 40 is affixed.

In still another embodiment of the invention, the spout can be graduated such that the user may allow only a predetermined amount of liquid to pass through the spout. This feature may rind use in situations where the user desires to empty just a predetermined portion of the fluid from the container.

It is important to note that the container may be fashioned from a material other than plastic. For example, a material such as rubber may provide ample flexibility and strength to accomplish the objectives of the invention.

As will be apparent to one of ordinary skill in the art, the preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

Having thus described our invention, we claim:

1. A container for holding liquid and dispensing the liquid into a port, the container comprising;

a body having a reservoir portion unitarily formed with a generally rigid spout, the reservoir portion having a lateral side portion and a top portion, the spout having an outer portion having an open outlet end and an inner portion extending from the top portion, the spout further having a passageway permitting communication of liquid between the reservoir and the outlet end when the spout is in an extended position, the spout further having means for folding the outer portion of the spout downwardly from the extended position to a folded position where the outlet end extends away from the top portion and outwardly from the side portion to permit insertion of the outlet end of the spout into the port, the means for folding being a bend portion formed between the outer portion and the inner portion of the spout to permit folding of opposing portions of the spout inwardly together to restrict flow of liquid through the passageway.

2. The container of claim 1, wherein the outer portion of the spout includes a threaded portion for receiving a cap.

3. The container of claim 1, wherein the bend portion is an annular groove.

4. The container of claim 1, wherein the bend portion extends around a circumference of the spout.

5. The container of claim 1, wherein the passage of the spout has a substantially uniform cross-section.

6. The container of claim 1, wherein the container is molded of plastic.

7. The container of claim 1, wherein the outlet has a predetermined diameter substantially equal to a cross-section of the passage.

8. The container of claim 1, wherein the container is made of a synthetic material.

* * * * *